US008888513B2

(12) United States Patent
Shi et al.

(10) Patent No.: US 8,888,513 B2
(45) Date of Patent: Nov. 18, 2014

(54) PLUG ASSEMBLY AND ELECTRICAL CHARGER ASSEMBLY

(71) Applicants: Fu Tai Hua Industry (Shenzhen) Co., Ltd., Shenzhen (CN); Hon Hai Precision Industry Co., Ltd., New Taipei (TW)

(72) Inventors: Zhi-Jun Shi, Shenzhen (CN); Che-Yu Chou, New Taipei (TW); Qun Huang, Shenzhen (CN); Tai-Shan Zhu, Shenzhen (CN); Tao Jiang, Shenzhen (CN); Wen-Chih Lan, New Taipei (TW); Jun-Liang Zhang, Shenzhen (CN); Hai-Qian Ge, Shenzhen (CN); Wei-Wei Yu, Shenzhen (CN); Hua-Yong Wang, Shenzhen (CN); Ji-Bing Guo, Shenzhen (CN); Zhou Chen, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 23 days.

(21) Appl. No.: 13/870,942

(22) Filed: Apr. 25, 2013

(65) Prior Publication Data

US 2013/0288493 A1 Oct. 31, 2013

(30) Foreign Application Priority Data

Apr. 26, 2012 (CN) ..... 2012 1 01257112

(51) Int. Cl.
*H01R 13/44* (2006.01)
*H01R 31/06* (2006.01)

(52) U.S. Cl.
CPC ..... *H01R 13/44* (2013.01); *H01R 31/06* (2013.01)
USPC ..... 439/131

(58) Field of Classification Search
USPC ..... 439/131, 173, 174
See application file for complete search history.

(56) References Cited

U.S. PATENT DOCUMENTS

| | | | | |
|---|---|---|---|---|
| 4,997,381 | A * | 3/1991 | Oh | 439/172 |
| 6,126,460 | A * | 10/2000 | Wu | 439/131 |
| 6,275,002 | B1 * | 8/2001 | Chen | 320/111 |
| 6,835,903 | B1 * | 12/2004 | Liu et al. | 439/131 |
| 7,787,238 | B2 * | 8/2010 | Liao et al. | 361/679.01 |
| 7,946,868 | B1 * | 5/2011 | Chen | 439/173 |
| 7,985,083 | B2 * | 7/2011 | Hopwood et al. | 439/134 |
| 2009/0284221 | A1 * | 11/2009 | Liao | 320/111 |
| 2010/0291779 | A1 * | 11/2010 | Hopwood et al. | 439/131 |
| 2011/0143560 | A1 * | 6/2011 | Lee et al. | 439/108 |

* cited by examiner

*Primary Examiner* — Briggitte R Hammond
(74) *Attorney, Agent, or Firm* — Novak Druce Connolly Bove + Quigg LLP

(57) ABSTRACT

A plug assembly includes an accepting assembly and a power plug which is detachably inserted into the accepting assembly. The power plug includes a first housing, a rotating plug assembly, two conductive connecting blades, a transmission mechanism, and a locking mechanism. The accepting assembly includes a charger cover, two conductive poles, and a buckling mechanism received in the charger cover. The rotating plug assembly drives the transmission mechanism to move down to insert into the charger cover, drives the buckling block to move up to insert into the first housing, and drives locking blocks to move closer and lock with the buckling block; and in the retracted state, the rotating plug assembly drives the transmission mechanism to move up, drives the locking blocks to move further away from each other, such that the locking blocks release the buckling block.

20 Claims, 16 Drawing Sheets

PLUG ASSEMBLY AND ELECTRICAL CHARGER ASSEMBLY

BACKGROUND

1. Technical Field

The present disclosure generally relates to a plug assembly, and to an electrical charger assembly with the plug assembly.

2. Description of Related Art

Portable electronic devices, such as mobile phones and personal digital assistants (PDAs), are used all over the world. These portable electronic devices have individual rechargeable batteries as energy storage elements for providing operation voltages. When going outdoors people need to ensure that the batteries of their portable electronic devices have sufficient charge. Thus an electrical charger is needed to recharge the battery.

A typical charger may include a charger housing and a power plug connected to the charger housing. The power plug maybe a two-pin blade plug which includes two protruding pin plugs. However, the protruding pin plugs are liable to be damaged during packaging, transportation and storage of the power plug.

What is needed, therefore, is a means of overcoming the described limitations.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Reference will be made to the drawings to describe various embodiments.

Figure 1:
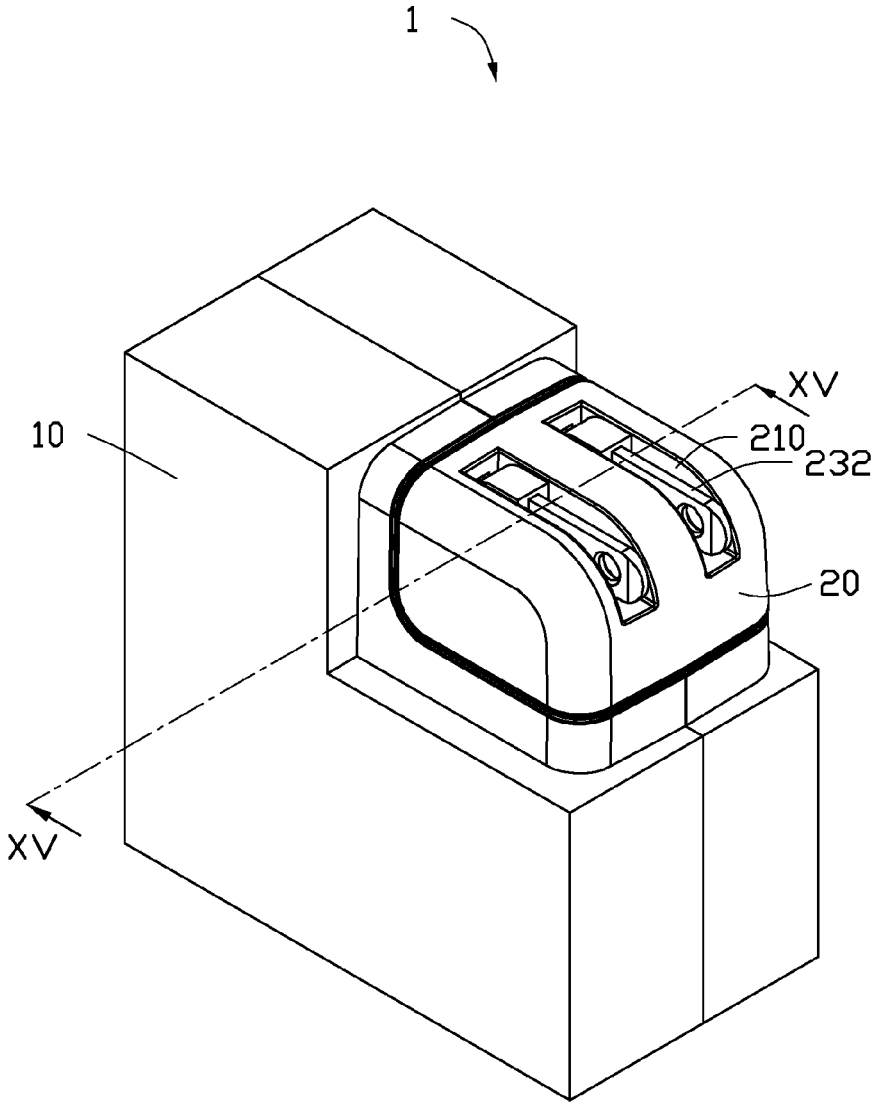
FIG. 1 is an isometric view of a charger assembly according to an exemplary embodiment of the present disclosure, wherein the charger assembly includes a power plug and a charger, and shows plug pins of the power plug in a retracted state.
Figure 2:
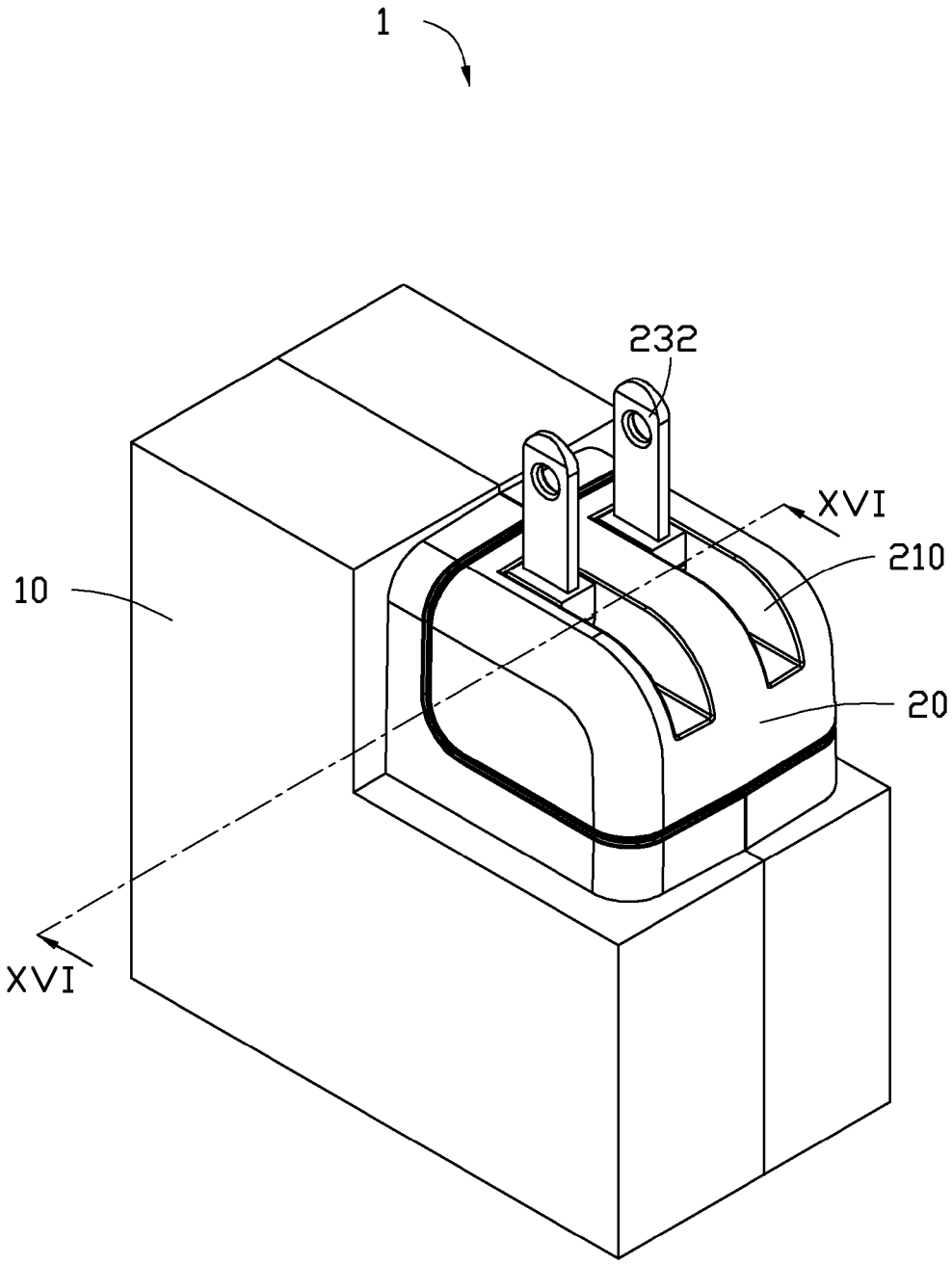
FIG. 2 is similar to FIG. 1, but showing the plug pins of the power plug in a protruding state.
Figure 3:
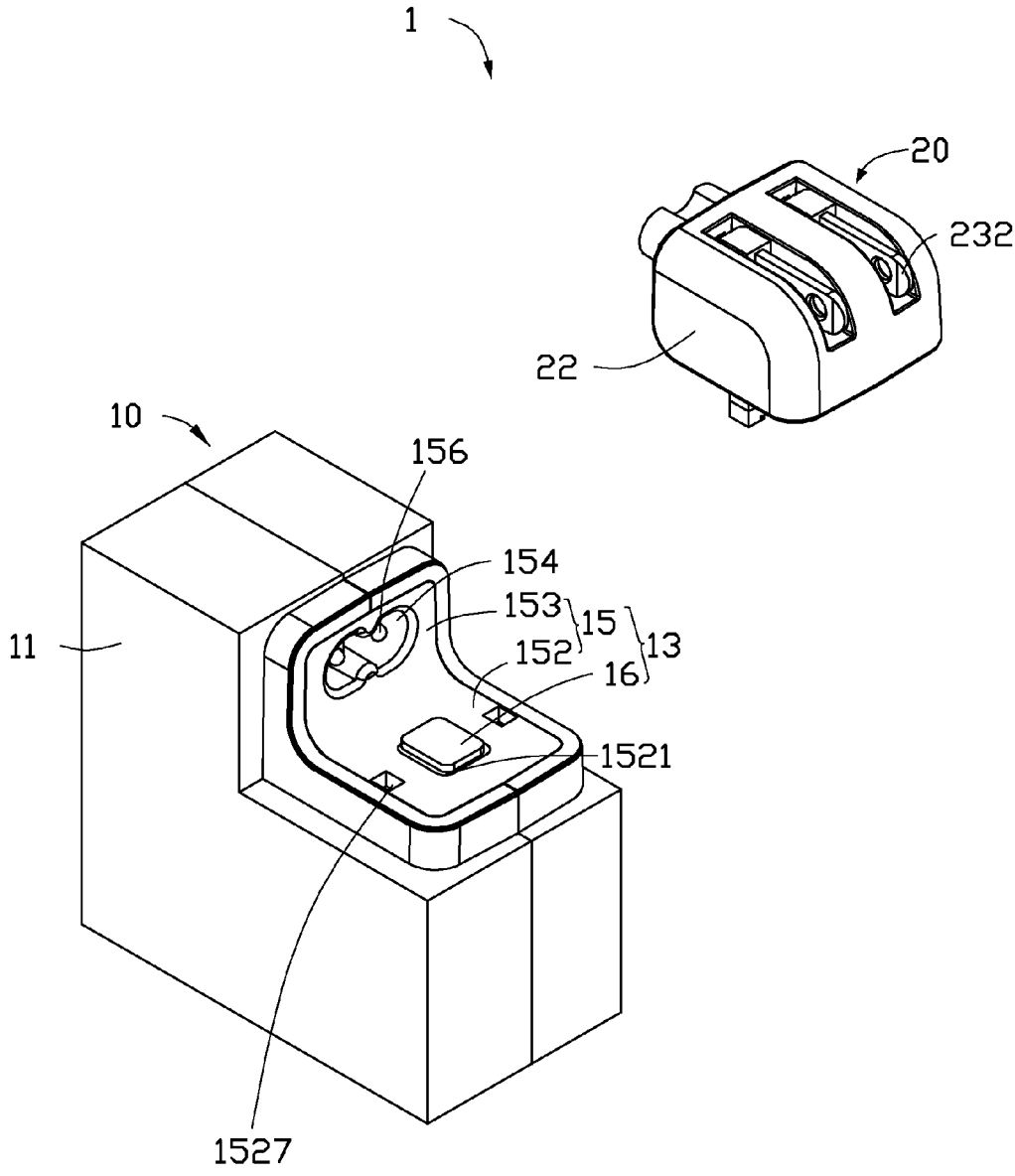
FIG. 3 is an isometric view of the charger assembly of FIG. 1, with the power plug unplugged from the charger, wherein the charger includes a charger body and an accepting assembly, and the accepting assembly includes a charger cover and a buckling mechanism received in the charger cover.

Referring to FIGS. 1-2, in one embodiment, a charger assembly 1 includes a charger 10 and a power plug 20. Referring also to FIG. 3, the charger 10 includes a charger body 11 and an accepting assembly 13. The accepting assembly 13 includes a charger cover 15 and a buckling mechanism 16 received in the charger cover 15. The charger body 11 is hollow and defines a cutout at a top front corner thereof. The charger cover 15 covers the charger body 12 at the cutout and detachably engages with the power plug 20.

The power plug 20 is detachably attached to the charger 10 and electrically connected with the charger 10. The power plug 20 includes a first housing 22 and two or more plug pins 232 for electrically connecting the charger 10 and a power source. The first housing 22 defines two slots 210, the plug pins 232 are rotatably fixed in the first housing 22 so as to be changeable between a retracted state and a protruding state. When the power plug 20 is in the retracted state (see FIG. 1), the plug pins 232 are substantial completely retracted in the slots 210. When the power plug 20 is in the protruding state (see FIG. 2), the plug pins 232 for connecting with the power supply protrude out of the slots 210.

Figure 4:
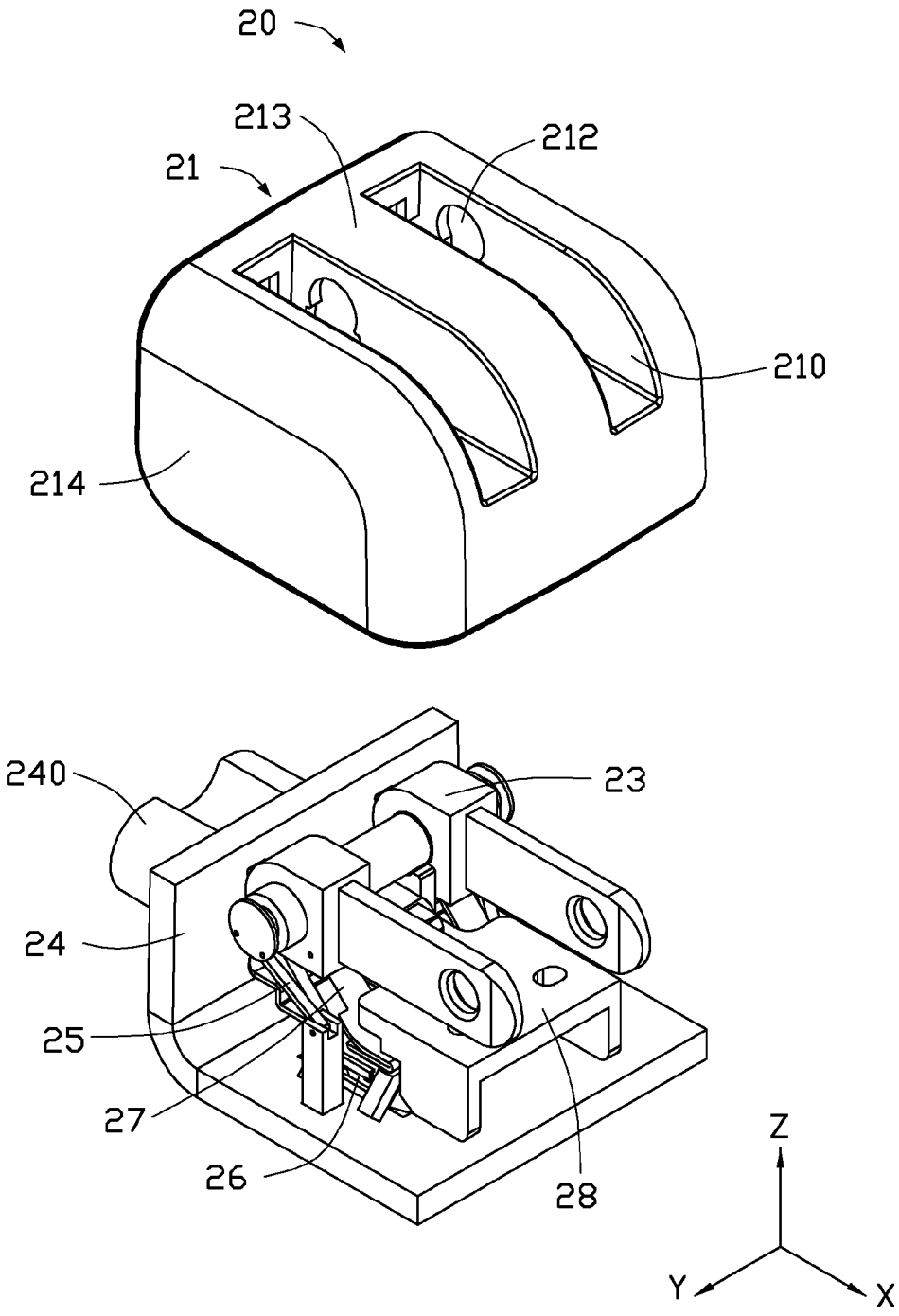
FIG. 4 is an isometric view of the power plug of FIG. 3, wherein the power plug includes a first housing, a rotating plug assembly, a transmission mechanism, a locking mechanism, a supporting table, and two conductive connecting blades, the first housing includes a cover and a seat, and shows the cover disengaged with seat.

Referring also to FIG. 4, the first housing 22 includes a cover 21 and a seat 24. The cover 21 includes a top plate 213 and three sidewalls 214 connected with three edges of the top plate 213. The three sidewalls 214 connect end to end to form a first space which exposes to the outside at a bottom side and a front side. The seat 24 is attached to cover the exposed sides of the cover 21. The top plate 213 defines the two slots 210 at a surface facing away from the first space. The two slots 210 extend along a first direction, such as a direction parallel to an X axis as shown in FIG. 4. The first housing 22 further defines a hole 212 extending along a second direction, such as a direction parallel to a Y axis as shown in FIG. 4, perpendicular to the first direction and communicating with the slots 210.

The power plug 20 further includes a rotating plug assembly 23, a transmission mechanism 25, a locking mechanism 26, two conductive connecting blades 27, and a supporting table 28. The rotating plug assembly 23, the transmission mechanism 25, the locking mechanism 26, the two conductive connecting blades 27, and the supporting table 28 are received in the first housing 22.

Figure 5:
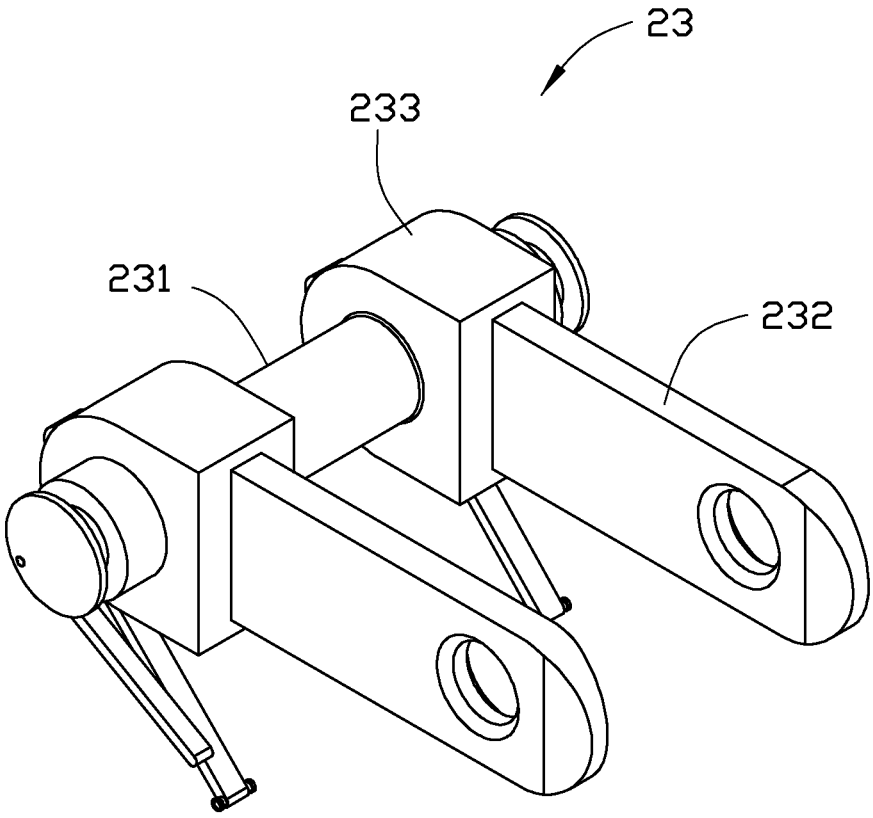
FIG. 5 is an enlarged isometric view of the rotating plug assembly of the power plug of FIG. 4.
Figure 6:
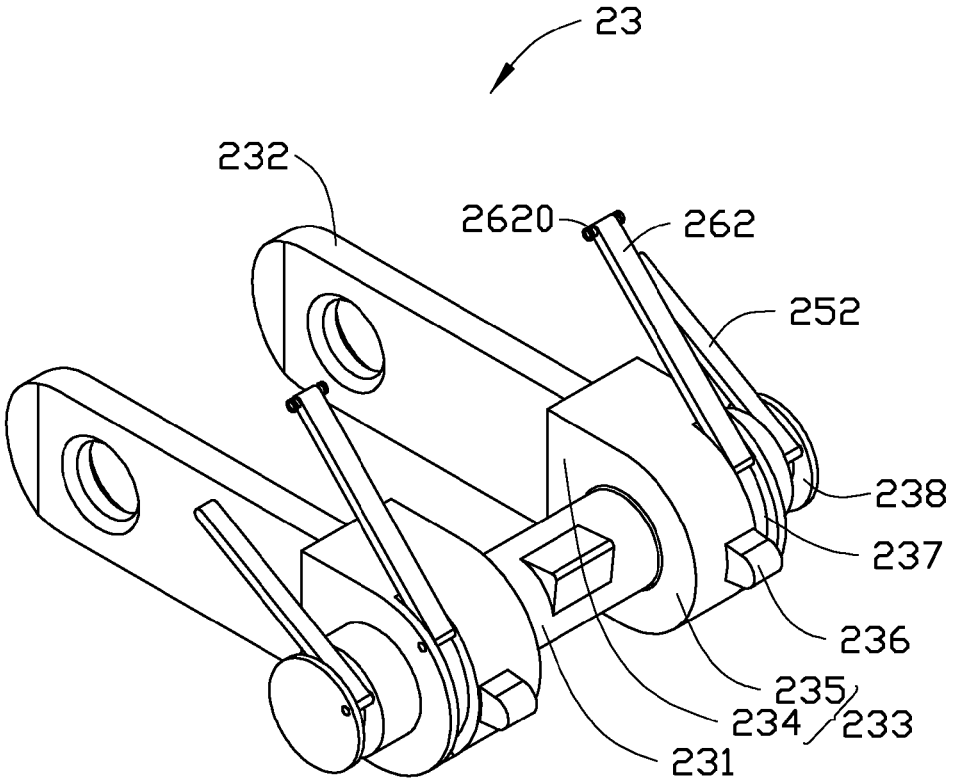
FIG. 6 is similar to FIG. 5, but viewed from another aspect.

Referring also to FIGS. 5-6, the rotating plug assembly 23 includes a rotating spindle 231, two controlling portions 233, and two plug pins 232. The rotating spindle 231 is arranged above the seat 24 and is fixed in the hole 212 of the first housing 22 to extend along the second direction. The rotating spindle 231 defines two first fixing grooves 238 at opposite distal ends. Each first fixing groove 238 surrounds a circumference of the rotating spindle 231. The two controlling portions 233 are firmly sleeved on the rotating spindle 231, and located between the two first fixing grooves 238. Each controlling portion 233 includes a first side 234 and a second side 235 opposite to the first side 234. Each plug pin 232 is connected with a first side 234 of a corresponding controlling portion 233. Each controlling portion 233 defines a second fixing groove 237 at a second side 235 of the controlling portion 233. A conductive protrusion 236 is also formed on the second side 235 of each controlling portion 233 and electrically connected to a corresponding plug pin 232. In this embodiment, the first side 234 is a flat surface, and the second side 235 is a semi-circular surface around the rotating spindle 231, and the second fixing groove 237 surrounds a circumference of the semi-circular surface.

Figure 7:
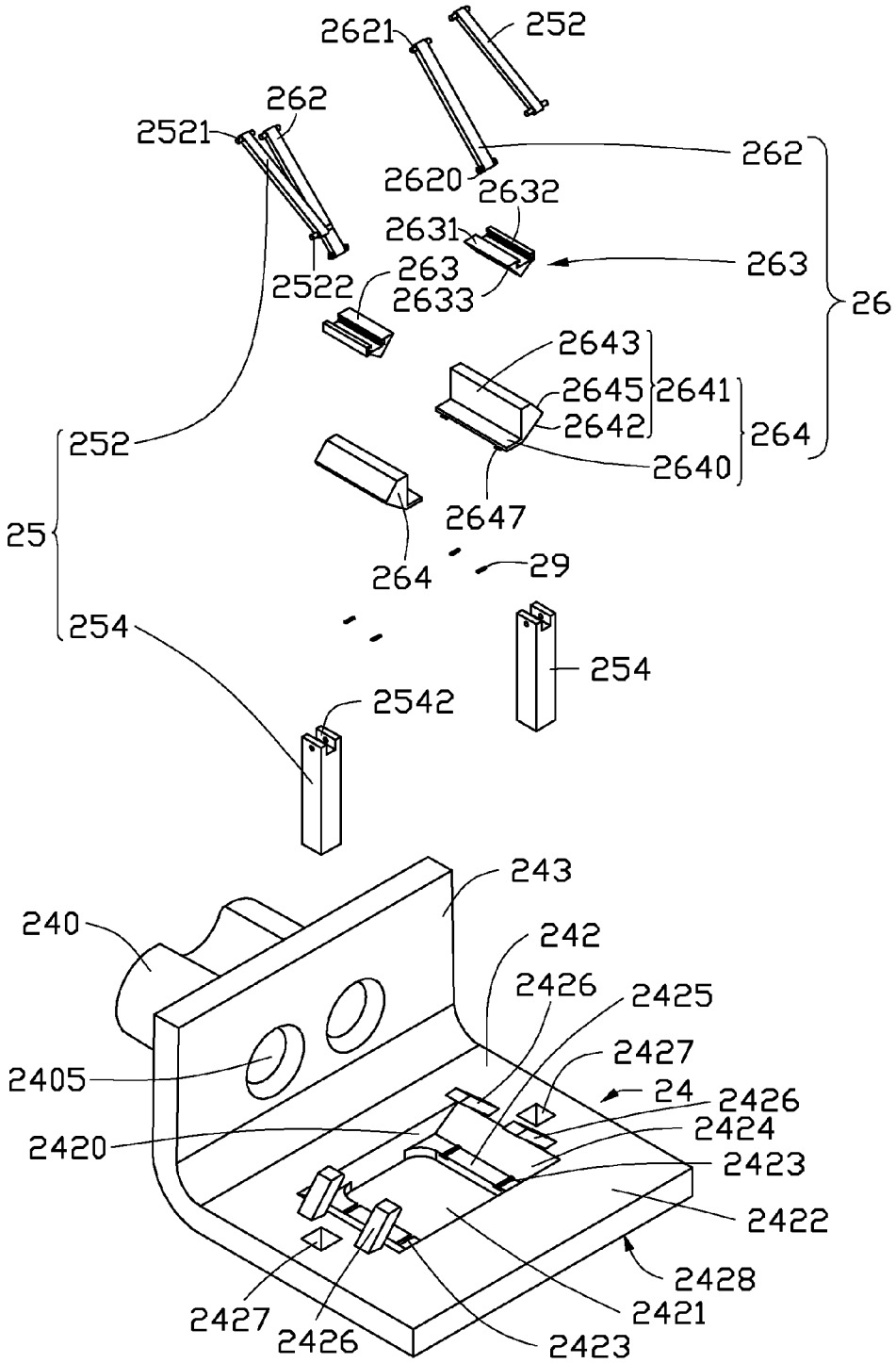
FIG. 7 is an exploded, isometric view of the seat, the transmission mechanism, and the locking mechanism of the power plug of FIG. 4.

Referring also to FIG. 7, the seat 24 includes a lower plate 242, a first side plate 243 connected to the lower plate 242, and an inserting portion 240 connected to the first side plate 243. The lower plate 242 and the first side plate 243 form an L-shaped profile. The lower plate 242 includes a top surface 2422 and a bottom surface 2428. The lower plate 242 defines an isosceles trapezoid groove 2420 and a first through hole 2421 below a bottom of the isosceles trapezoid groove 2420. A depth of the isosceles trapezoid groove 2420 is less than a thickness of the lower plate 242. An area of an upper surface of the isosceles trapezoid groove 2420 is greater than an area of a bottom surface of the isosceles trapezoid groove 2420. The top surface 2422 bounds the upper surface of the isosceles trapezoid groove 2420, and two first slant surfaces 2424 bound the waists of the isosceles trapezoid groove 2420. Because the depth of the isosceles trapezoid groove 2420 is less than the thickness of the lower plate 242, therefore two flat plates 2425 connected with the first slant surfaces 2424 bounds a partial bottom surface of the isosceles trapezoid groove 2420, and the two flat plates 2425 defines the first through hole 2421. Each flat plate 2425 defines two receiving slots 2423 extending along the second direction. Each receiving slot 2423 resembles the letter "T" as viewed in FIG. 5; and includes a narrow portion at an upper surface of the flat plate 2425, and a wide portion below the narrow portion.

The lower plate 242 further defines two second through holes 2427 and includes four slant pillars 2426 on the top surface 2422. One of the two second through holes 2427 and two slant pillars 2426 are located at a same side of the isosceles trapezoid groove 2420 besides one of the two first slant surfaces 2424, and the other one of the two second through holes 2427 and two slant pillars 2426 are located at an opposite side of the isosceles trapezoid groove 2420 besides the other one of the two first slant surfaces 2424. At each side of the opposite sides of the isosceles trapezoid groove 2420, the second through hole 2427 is located between the slant pillars, and a distance between the second through hole 2427 and the isosceles trapezoid groove 2420 is greater than a distance between the slant pillars and the isosceles trapezoid groove 2420. The inserting portion 240 protrudes from a bottom surface of the first side plate 243. The inserting portion 240 defines two inserting holes 2405. The inserting holes 2405 passes through both the first side plate 243 and the inserting portion 240.

The transmission mechanism 25 includes two transmission parts. The transmission parts are located to be mirror images of each other. Each transmission part 250 includes a first connecting rod 252 and a transmission pole 254 extending along a third direction, such as a direction parallel to a Z axis as shown in FIG. 4. The transmission pole 254 defines a cutout 2542 at a first distal end thereof, and an opening of the cutout 2542 faces the rotating spindle 231. A first distal end of the first connecting rod 252 is rotatably attached to an inner surface of the first fixing groove 238 via a spindle 2521 extending along the second direction, and a second distal end of the first connecting rod 252 is rotatably attached to an inner surface of the cutout 2542 via a spindle 2522 extending along the second direction. When the rotating plug assembly 23 rotates, the transmission poles 254 move up and down along the third direction.

The locking mechanism 26 includes two locking parts. The locking parts are located to be mirror images of each other. Each locking part 260 includes a second connecting rod 262, a sliding block 263, and a locking block 264. The locking block 264 includes a first locking plate 2641 and a second locking plate 2640 perpendicularly connected to the first locking plate 2641. The first locking plate 2641 includes a vertical surface 2643 perpendicular to the second direction, a second slant surface 2642, a third slant surface 2645. The second slant surface 2642 interconnects the vertical surface 2643 and the third slant surface 2645. The second slant surface 2642 matches with the first slant surface 2424 of the lower plate 242. The second locking plate 2640 is a flat plate, two fixing protrusions 2647 protrude from a bottom surface of the second locking plate 2640. Each fixing protrusion 2647 includes a first portion and a second portion, wherein the first portion interconnects the second portion and the second locking plate 2640. In the illustrated embodiment, the first portion is in the form of a neck, and the second portion is in the form of a head. The first portion perpendicularly protrudes from the bottom surface of the second locking plate 2640.

The sliding block 263 includes a top surface 2631 and a fourth slant surface 2633. The fourth slant surface 2633 matches with the third slant surface 2645 of the locking block 264. The sliding block 263 further defines a sliding slot 2632 at the top surface 2631. The sliding slot 2632 resembles the letter "T" as viewed in FIG. 7; and includes a narrow portion at the top surface 2631 of the sliding block 263, and a wide portion below the narrow portion. A first distal end of the second connecting rod 262 is rotatably attached to an inner surface of the second fixing groove 237 via a spindle 2621 extending along the second direction, and a second distal end of the second connecting rod 262 is movably received in the sliding slot 2632 via a sliding spindle 2622. The sliding spindle 2622 is extending along the second direction and movably received in the wide portion of the sliding slot 2632.

Figure 8:
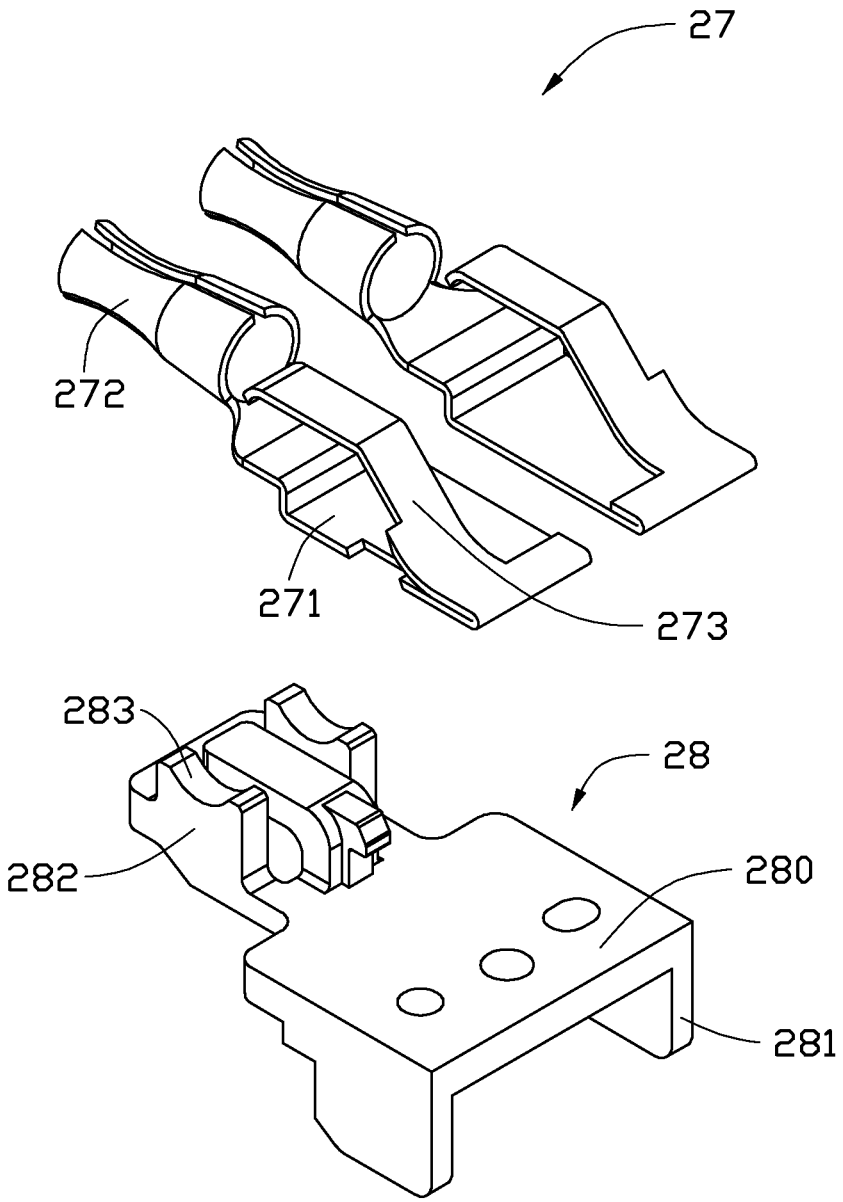
FIG. 8 is an enlarged, isometric view of the conductive connecting blades and the supporting table of the power plug of FIG. 4.

Referring also to FIG. 8, the conductive connecting blades 27 are mirror images of each other. Each conductive connecting blade 27 includes a connecting piece 271, a cylinder piece 272, and a bent piece 273. The connecting piece 271 interconnects the cylinder piece 272 and the bent piece 273. The bent piece 273 includes a flat portion 2731 and a slant portion 2732. The slant portion 2732 interconnects the flat portion 2731 and the connecting piece 271. The cylinder piece 272 and the bent piece 273 are located at a same side of the connecting piece 271.

The supporting table 28 includes a horizontal plate 280, two first vertical plates 281, and two second vertical plates 282. The first and second vertical plates 281, 282 perpendicularly extend from two opposite sides of the horizontal plate 280. The first and second vertical plates 281, 282 extend away from each other in substantially opposite directions. Each second vertical plate 282 includes a curved surface 283. The curved surface 283 matches with the rotating spindle 231.

Figure 9:
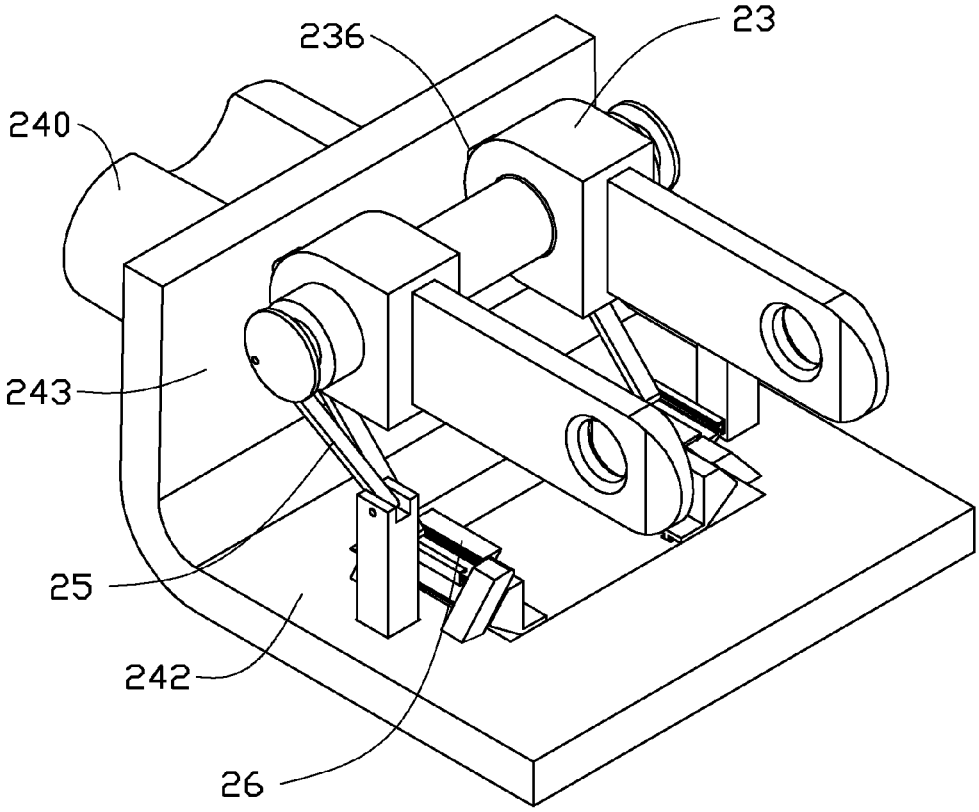
FIG. 9 is an assembled view of the power plug of FIG. 4, but omitting the cover, the conductive connecting blades, and the supporting table.

Referring also to FIG. 9, in assembly of the power plug 20, the rotating plug assembly 23 is rotatably fixed in the first housing 22. The first distal ends of the first connecting rods 252 are rotatably attached to the inner surfaces of the first fixing grooves 238 via spindles 2521, and the second distal ends of the first connecting rods 252 are rotatably attached to the inner surfaces of the cutouts 2542 of the transmission poles 254 via spindles 2522. Second distal ends of the transmission poles 254 opposite to the first distal ends of the transmission poles 254 pass through the second through holes 2427 and protrude out of the lower plate 242. When the rotating plug assembly 23 rotates between the retracted state and the protruding state, the first connecting rods 252 drive the transmission poles 254 to move up and down along the third direction.

Figure 15:
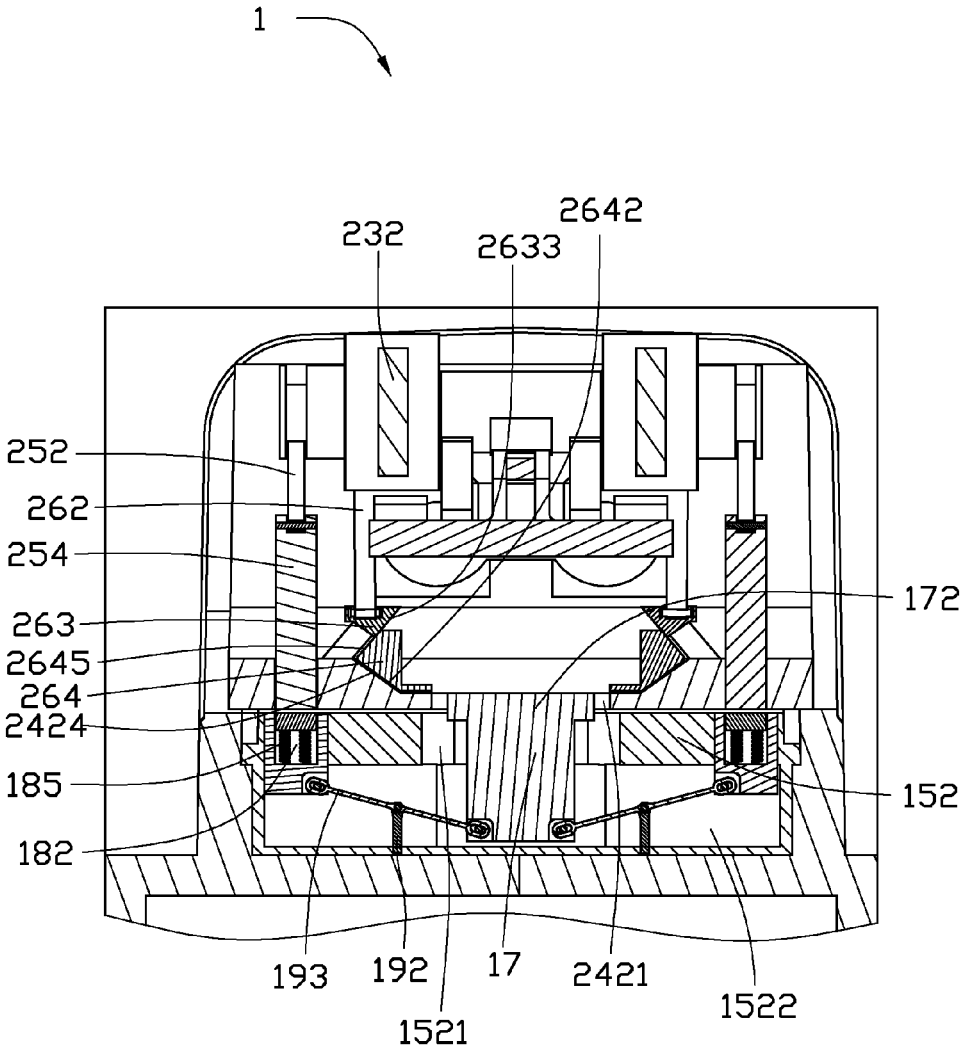
FIG. 15 is a cross-sectional view of the charger assembly of FIG. 1, corresponding to line XV-XV thereof.
Figure 16:
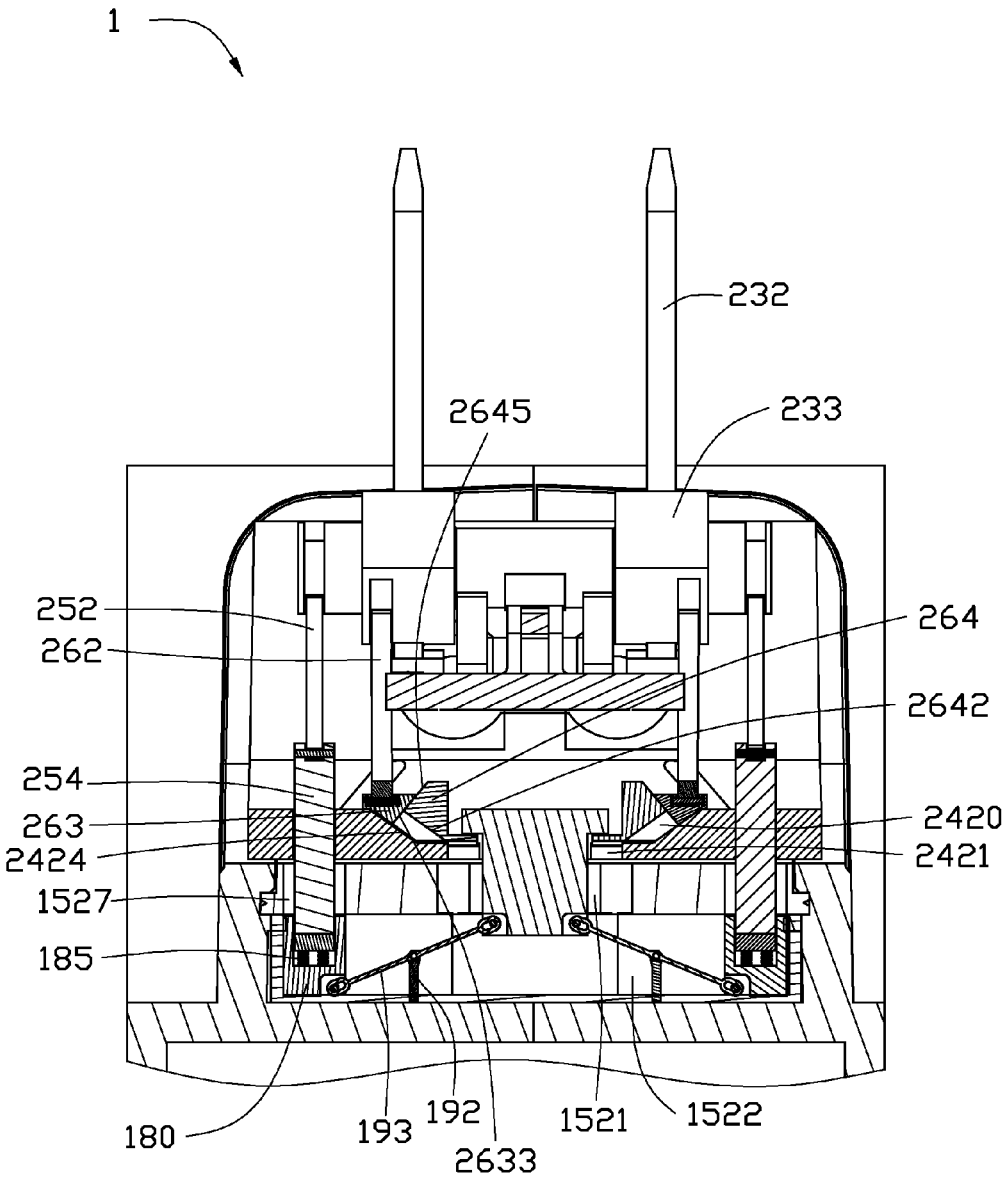
FIG. 16 is a cross-sectional view of the charger assembly of FIG. 2, corresponding to line XVI-XVI thereof.

The first distal ends of the second connecting rods 262 are rotatably attached to the inner surfaces of the second fixing grooves 237 via spindles 2621, and the second distal ends of the second connecting rods 262 are movably received in the sliding slots 2632 of the sliding blocks 263, with the sliding spindles 2620 movably received in the wide portion of the sliding slots 2632. The sliding blocks 263 are located besides the waists of the isosceles trapezoid groove 2420 and each of the sliding blocks 263 is limited between two slant pillars 2426. The locking blocks 264 are located between the sliding blocks 263 and attached to the flat plates 2425 of the lower plate 242 by inserting the fixing protrusions 2647 into the receiving slots 2423 of the flat plates 2425. The third slant surfaces 2645 of the locking blocks 264 abut the fourth slant surfaces 2633 of the sliding blocks 263. Four elastic members 29 elastically connect the fixing protrusions 2647 in the receiving slots and apply resilient force to the fixing protrusions 2647 when the fixing protrusions 2647 move back and forth along the second direction in the receiving slots 2423. When the rotating plug assembly 23 rotates between the retracted state and the protruding state, the second connecting rods 262 drive the sliding blocks 263 move up and down along the third direction. Because the third slant surfaces 2645 of the locking blocks 264 abut the fourth slant surfaces 2633 of the sliding blocks 263, thus the sliding blocks 263 drive the locking blocks 264 move back and forth along the second direction, such that the locking blocks 264 move closer to each other to cover a partial portion of the first through hole 2421 of the seat 24 (see FIG. 16) or move further away from each other until the second slant surface 2642 abut the first slant surface 2424 of the seat 24 to expose whole of the first through hole 2421 of the seat 24 (see FIG. 15).

Figure 10:
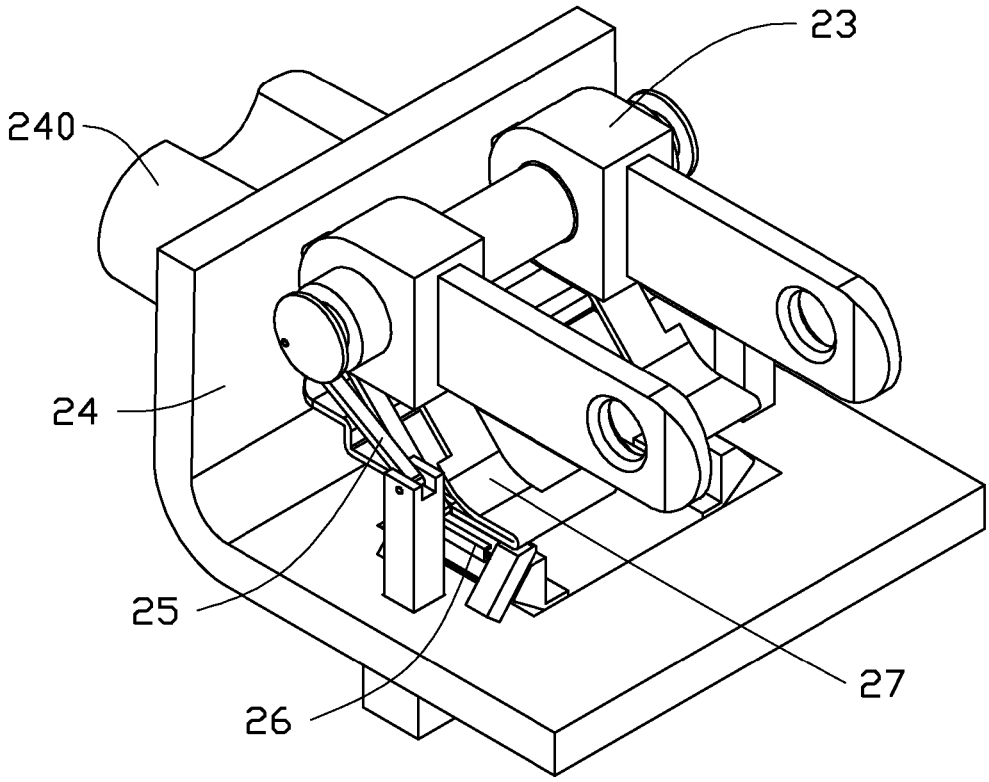
FIG. 10 is an assembled view of the power plug of FIG. 4, but omitting the cover and the supporting table.

Referring also to FIG. 10, the conductive connecting blades 27 is also fixed in the first housing 22 of the power plug 20. The cylinder pieces 272 are received in the inserting holes 2405, the connecting pieces 271 are arranged on slant pillars 2426, and the flat portions 2731 of the bent pieces 273 are located below the controlling portions 233 of the rotating plug assembly 23. When the rotating plug assembly 23 rotates between the retracted state and the protruding state, the conductive protrusions 236 rotate to face the first side plate 243 or to face and abut the flat portions 2731. When the rotating plug assembly 23 rotates to the retracted state, the conductive protrusions 236 rotate to face the first side plate 243, the conductive protrusions 236 disconnect with the conductive connecting blades 27, and thereby the plug pins 232 are not electrically connecting with the conductive connecting blades 27. When the rotating plug assembly 23 rotates to the protruding state, the conductive protrusions 236 rotate to face and abut the flat portions 2731 of the conductive connecting blades 27, thereby electrically connecting the plug pins 232 and the conductive connecting blades 27 via the conductive protrusions 236.

Figure 11:
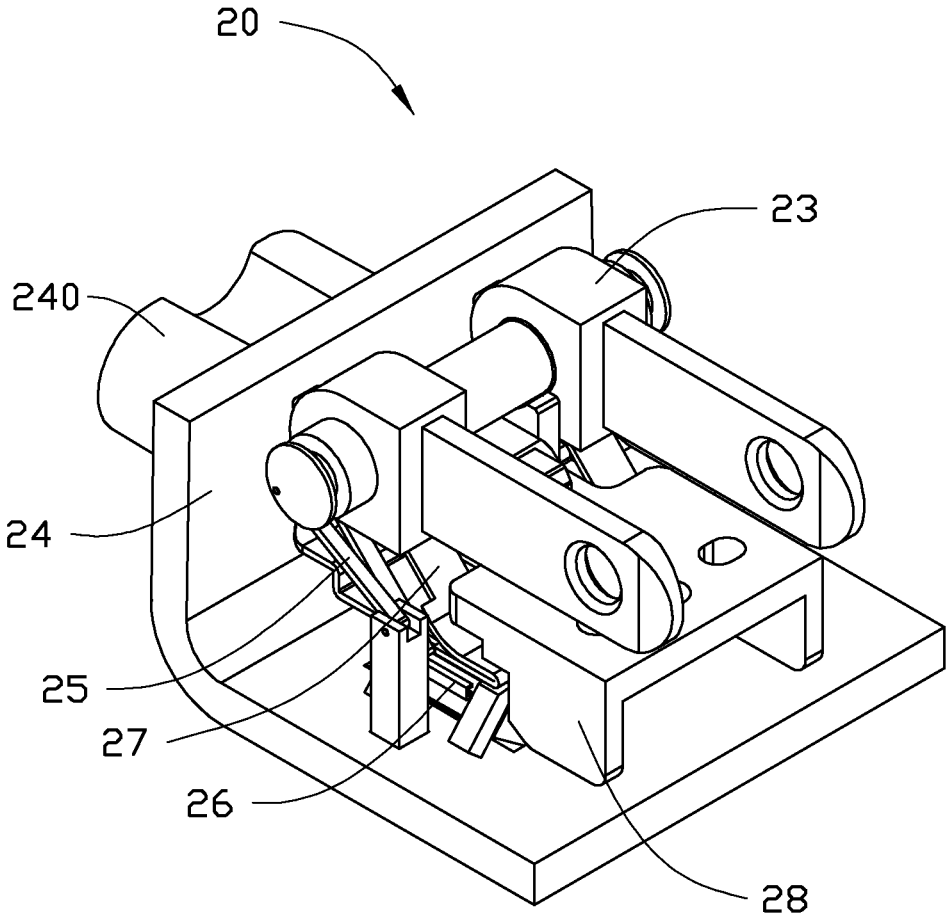
FIG. 11 is an assembled view of the power plug of FIG. 4, but omitting the cover.

Referring also to FIG. 11, the supporting table 29 is fixed in the first housing 22 of the power plug 20. The first vertical plates 281 are arranged on the lower plate 242, the second vertical plates 282 support the rotating spindle 231, and the curved surfaces 283 abut the periphery surface of the rotating spindle 231. Referring back to FIG. 4, the cover 21 engages with the seat 22 to receive the rotating plug assembly 23, the transmission mechanism 25, the locking mechanism 26, the two conductive connecting blades 27, and the supporting table 28.

Referring back to FIG. 3 and FIG. 14, the charger cover 15 includes a bottom plate 152, a second side plate 153 connected to the bottom plate 152, and an accepting portion 154 connected to the second side plate 153. The bottom plate 152 and the second side plate 153 form an L-shaped profile. The bottom plate 152 includes a third through hole 1521 corresponding to the first through hole 2421 and two fourth through holes 1527 corresponding to the second through holes 2427. A hollow protruding portion 1520 extends from a bottom surface of the bottom plate 152. An inner surface of the protruding portion 1520 and the bottom surface of the bottom plate 152 define an accommodating space 1522 to receive the buckling mechanism 16. The third through hole 1521 communicates with the accommodating space 1522.

The accepting portion 154 extends rearward out from the second side plate 153 at a side of the second side plate 153 opposite from the side where the bottom plate 152 is connected. The accepting portion 154 is hollow, and defines an accepting hole. The accepting portion 154 includes two conductive poles 156 received in the accepting hole, and the conductive poles 156 are electrically connected to inner circuits of the charger 10.

Figure 12:
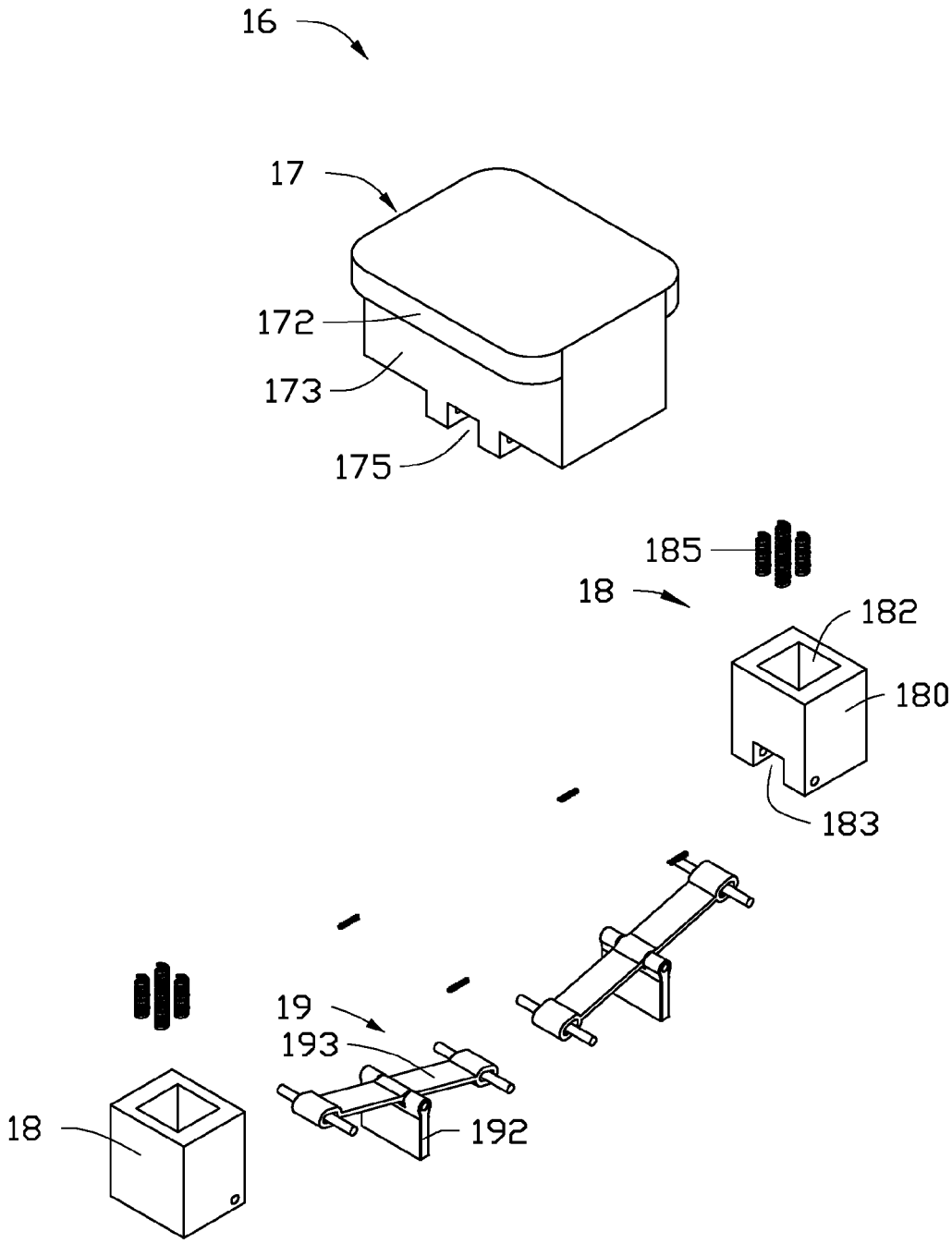
FIG. 12 is an exploded, enlarged, isometric view of the buckling mechanism of FIG. 3.

Referring also to FIG. 12, the buckling mechanism 16 includes two pressing blocks 18, two seesaw assemblies 19 located between the two pressing blocks 18, and a buckling block 17 located between the two seesaw assemblies 19. The buckling block 17 includes a head plate 172 and a main body 173 extending from the head plate 172. An area of the head plate 172 is greater than an area of the main body 173 adjacent to the head plate 172. The main body 173 defines two first cutouts 175 at opposite sides of a bottom surface of the main body 172 (see FIG. 14). The openings of each first cutout 175 face a bottom surface of the accommodating space 1522 and the seesaw assembly 19.

The pressing blocks 18 are mirror images of each other. Each pressing block 18 is configured to move up and down along the third direction in the fourth through hole 1527 and the accommodating space 1522. Each pressing block 18 defines a receiving groove 182 at a top surface thereof and a second cutout 183 at a bottom surface thereof. A plurality of second elastic members 185 are fixed in the receiving grooves 182. The openings of each second cutout 183 face the bottom surface of the accommodating space 1522 and the seesaw assembly 19. A weight of the buckling block 17 is greater than a sum weight of the two pressing blocks 18.

The seesaw assemblies 19 are mirror images of each other. Each seesaw assembly 19 includes a fixing plate 192 and a seesaw plate 193. Center of each seesaw plate 193 is rotatably fixed to a corresponding fixing plate 192. First distal ends of the seesaw plates 193 face the buckling block 17, and second distal ends of the seesaw plates 193 face the pressing blocks 18.

Figure 13:
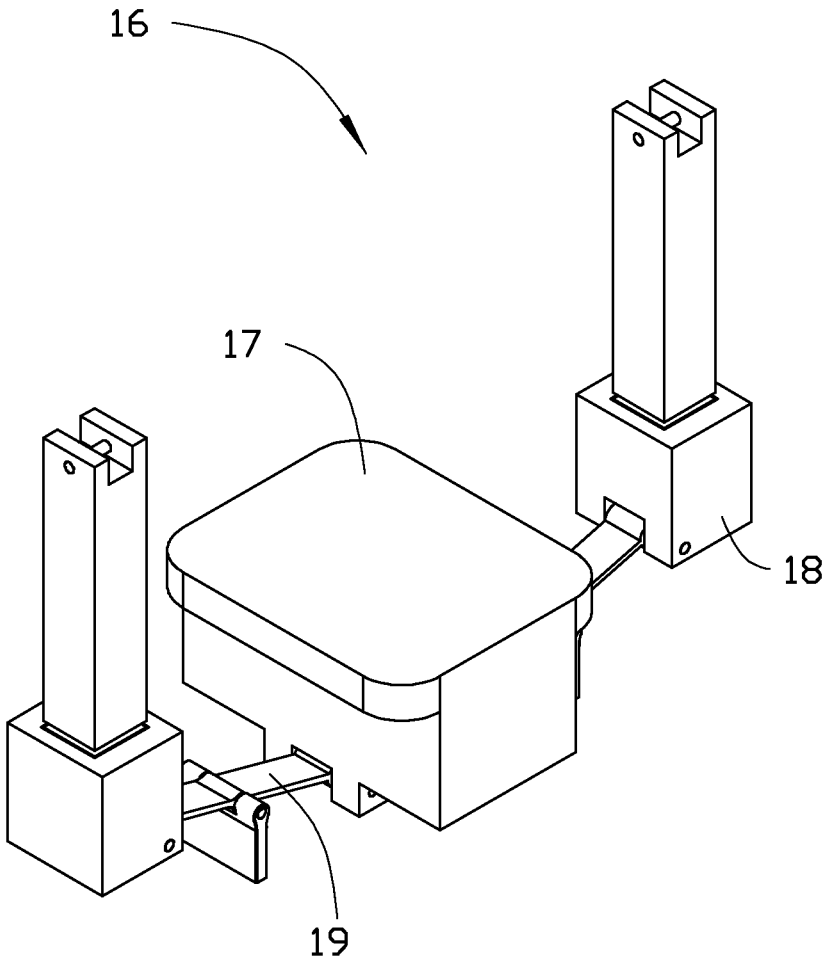
FIG. 13 is an assembled view of the buckling mechanism of FIG. 12.
Figure 14:
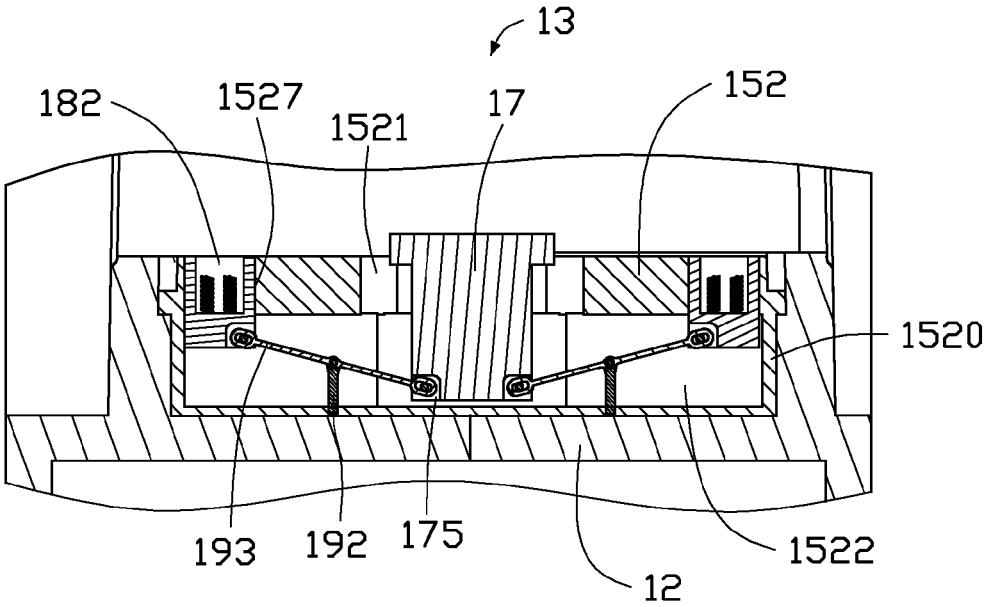
FIG. 14 is a partial cross-sectional view of the charger of FIG. 3.

Referring also to FIGS. 13-14, in assembly of the charger 10, the charger cover 15 covers the charger body 12 at the cutout. The buckling mechanism 16 is received in the accommodating space 1522 of the charger cover 15. The fixing plates 192 are attached to the bottom surface of the accommodating space 1522, the seesaw plates 193 are rotatably fixed to the fixing plates 192. First distal ends of the seesaw plates 193 are rotatably attached to the inner surfaces of the first cutouts 175 of the buckling block 17. Second distal end of the seesaw plates 193 are rotatably attached to the inner surfaces of the second cutouts 183 of the pressing blocks 18.

Because the weight of the buckling block 17 is greater than the sum weight of the two pressing blocks 18, when no external force is applied to the pressing blocks 18, the buckling block 17 drives the pressing blocks 18 to move up along the third direction by the seesaw assemblies 19, and most portion of the pressing blocks are inserted into the fourth through hole 1527. When external forces are exerted to the pressing blocks 18, the pressing blocks are driven to move down along the third direction and retract into the accommodating space 1522, thus drive the buckling block 17 to move up via the seesaw assemblies 19.

Referring back to FIG. 1, FIG. 7 and FIG. 15, in assembly of the charger assembly 10, the rotating plug assembly 23 of the power plug is rotated to the retracted state, the conductive protrusions 236 rotate to face the first side plate 243, the conductive protrusions 236 disconnect with the conductive connecting blades 27, and thereby the plug pins 232 are not electrically connecting with the conductive connecting blades 27. The transmission poles 254 move up, second distal ends of the transmission poles 254 protruded out of the second through hole 2427 are inserted into the receiving grooves 182 of the pressing blocks 18, and a length of each second distal end of the transmission poles 254 protruded out of the second through hole 2427 is minimum. The sliding blocks 263 move up, and the first elastic members 29 drive the locking blocks 264 move further away from each other until the second slant surface 2642 abut the first slant surface 2424 to expose the whole of the first through hole 2421. Therefore, the plug power 20 can be plugged into the charger 10 freely.

When the power plug 20 is plugged into the charger 10 at the retracted state, the inserting portion 240 is inserted into the accepting hole of the accepting portion 154, the conductive poles 156 of the accepting portion 154 is inserted into the cylinder pieces 272 of the conductive connecting blades 27, therefore electrically connects the conductive connecting blades 27 to the inner circuits of the charger 10 via the conductive poles 156. Because the length of the second ends of the transmission poles 254 protruded out of the second through hole 2427 is minimum, when the second ends of the transmission poles 254 protruded out of the second through hole 2427 are inserted into the receiving grooves 182 of the pressing blocks 18, there are no external force exerted to the buckling assembly 16. The head plate 172 corresponds to the first through hole 2421.

Referring back to FIG. 2 and FIG. 16, in use of the charger assembly 1, the power plug 20 should be switched to the protruding state from the retracted state, at the protruding state of the charger assembly 1, the rotating plug assembly 23 is rotated to the protruding state, the conductive protrusions 236 abut the flat portions 2731 of the conductive connecting blades 27, thereby electrically connecting the plug pins 232 and the conductive connecting blades 27 via the conductive protrusions 236. The power plug 20 is adapted for connection to a socket of an external AC power source, and the inserting portion 240 of the power plug 20 is inserted into the accepting portion 154 of the accepting assembly 13, thereby allowing the operation voltage of the AC power source to be applied to the charger 10, and the charger 10 can function to recharge batteries.

At the protruding state of the charger assembly 1, the rotating plug assembly 23 also drives the transmission poles 254 to move down along the third direction and exert an external force to the buckling assemblies 16 via the second elastic members 185, thus driving the pressing block 180 to move down along the third direction, thereby driving the buckling block 17 to move up. The head plate 172 passes through the first through hole 2421 and inserts into the isosceles trapezoid groove 2420. The rotating plug assembly 23 drives the sliding blocks 263 to move down, thus driving the locking blocks to move closer to cover a partial portion of the first through hole 2421. The second locking plates 2640 of the locking blocks 264 locate below the head plate 172 of the buckling block 17 and lock the head plate 172 to the locking blocks 264. The power plug 20 is firmly fixed to the charger 10.

With the above-described configuration, at the retracted state of the charger assembly 1, the power plug 20 is free to be plugged into the charger 10 and unplugged from the charger 10. When the charger assembly 1 is in use, the power plug 20 is plugged into the charger 10, and the charger assembly 1 is switched to the protruding state, thereby firmly fixing the power plug to the charger 10. When the power plug 20 need to be unplugged, the charger assembly 1 can be switched to the retracted state, and then the power plug 20 can be unplugged from the charger 10. Furthermore, because the power plug 20 of the charger assembly 1 can be switched between the retracted state and the protruding state, therefore during packaging, transportation and storage of the power plug 20, the power plug 20 can be switched to the retracted state, thereby preventing damage of the plug pins 232 of the power plug 20.

It is believed that the present embodiments and their advantages will be understood from the foregoing description, and it will be apparent that various changes may be made thereto without departing from the spirit and scope of the embodiments or sacrificing all of their material advantages.

What is claimed is:

1. A plug assembly, comprising:

a power plug comprising a first housing defining at least two slots extending along a first direction, a rotating plug assembly, two conductive connecting blades, a transmission mechanism, and a locking mechanism comprising two locking blocks, the conductive connecting blades fixed to an inserting portion of the first housing, the rotating plug assembly comprising at least two plug pins adapted to connect with a socket of an external power source and configured to be rotatably fixed in the first housing to make the rotating plug assembly connect with the conductive connecting blades or disconnect with the conductive connecting blades, such that the rotating plug assembly changeable between a retracted state and a protruding state, the two locking blocks received in the first housing and configured to move closer or further away from each other along a second direction perpendicular to the first direction, and the transmission mechanism received in the first housing and configured to move up and down along a third direction perpendicular to the first and second directions; and an accepting assembly comprising two conductive poles structured and arranged to be electrically connected to circuit elements of a desired electrical device, a charger cover, and a buckling mechanism received in the charger cover, the buckling mechanism comprising a buckling block configured to move up and down along the third direction, the two conductive poles fixed to an accepting portion of the charger cover which detachably engaged with the inserting portion and allows the inserting portion to be inserted into the accepting portion to make the conductive connecting blades electrically connect with the conductive poles;

wherein in the protruding state, the rotating plug assembly connects with the conductive connecting blades such that the operation voltage of the external power source is applied to the circuit elements of the electrical device, the rotating plug assembly drives the transmission mechanism to move down to insert into the charger cover, drives the buckling block to move up to insert into the first housing, and drives the locking blocks move closer and lock with the buckling block; and in the retracted state, the rotating plug assembly disconnects with the conductive connecting blades, the rotating plug assembly drives the transmission mechanism move up, drives the locking blocks to move further away from each other, such that the locking blocks release the buckling block.

2. The plug assembly of claim 1, wherein the first housing comprises a cover and a seat, the cover comprises a top plate and three sidewalls connected with three edges of the top plate, the three sidewalls connect end to end to form a first space which is exposed to the outside at a bottom side and a front side, the seat is attached to cover the exposed sides of the cover, the at least two slots comprises two slots, the top plate of the cover defines the two slots at a surface facing away from the first space, and the first housing further defines a hole extending along the second direction and communicating with the two slots.

3. The plug assembly of claim 2, wherein the rotating plug assembly comprises a rotating spindle, two controlling portions, and two plug pins, the rotating spindle is rotatably fixed in the hole of the first housing to extend along the second direction, the rotating spindle defines two first fixing grooves at opposite distal ends, each first fixing groove surrounds a circumference of the rotating spindle, the two controlling portions are sleeved on the rotating spindle, and located between the two first fixing grooves, each controlling portion comprises a first side and a second side opposite to the first side, each plug pin is connected with a first side of a corresponding controlling portion, each controlling portion defines a second fixing groove at a second side of the controlling portion, a conductive protrusion is formed on the second side of each controlling portion and electrically connected to the corresponding plug pin, the conductive protrusions rotate in unison with the rotating spindle to connect with the conductive connecting blades or disconnect with the conductive connecting blades.

4. The plug assembly of claim 3, wherein the seat comprises a lower plate and a first side plate connected to the lower plate, the inserting portion is connected to the first side plate, the inserting portion defines two inserting holes, and the inserting holes passes through both the first side plate and the inserting portion, each conductive connecting blade comprises a connecting piece, a cylinder piece, and a bent piece, the connecting piece interconnects the cylinder piece and the bent piece, the cylinder piece and the bent piece are located at a same side of the connecting piece, the cylinder pieces are received in the inserting holes of the inserting portion, and the bent pieces are configured to connect with the conductive protrusions.

5. The plug assembly of claim 4, wherein the lower plate includes a top surface and a bottom surface, the lower plate defines an isosceles trapezoid groove and a first through hole below a bottom of the isosceles trapezoid groove, a depth of the isosceles trapezoid groove is less than a thickness of the lower plate, an area of an upper surface of the isosceles trapezoid groove is greater than an area of a bottom surface of the isosceles trapezoid groove, the top surface bounds the upper surface of the isosceles trapezoid groove, and two first slant surfaces bound the waists of the isosceles trapezoid groove, two flat plates connected with the first slant surfaces bounds a partial bottom surface of the isosceles trapezoid groove, and the two flat plates defines the first through hole, each flat plate defines two receiving slots extending along the second direction, each receiving slot comprises a narrow portion at an upper surface of the flat plate, and a wide portion below the narrow portion, the lower plate further defines two second through holes and includes four slant pillars on the top surface, one of the two second through holes and two slant pillars are located at a same side of the isosceles trapezoid groove besides one of the two first slant surfaces, and the other one of the two second through holes and two slant pillars are located at an opposite side of the isosceles trapezoid groove besides the other one of the two first slant surfaces, at each side of the opposite sides of the isosceles trapezoid groove, the second through hole is located between the slant pillars, and a distance between the second through hole and the isosceles trapezoid groove is greater than a distance between the slant pillars and the isosceles trapezoid groove.

6. The plug assembly of claim 5, wherein the locking mechanism comprises two locking parts, each locking part comprises a second connecting rod, a sliding block, and the locking block, the locking block comprises a first locking plate and a second locking plate connected to the first locking plate, the first locking plate comprises a vertical surface perpendicular to the second direction, a second slant surface, and a third slant surface, the second slant surface interconnects the vertical surface and the third slant surface, the second slant surface matches with the first slant surface of the lower plate, the second locking plate is a flat plate, two fixing protrusions protrude from a bottom surface of the second locking plate, each fixing protrusion matches with the receiving slot, elastic members are fixed in the receiving slots and configured to elastically connect the fixing protrusions in the receiving slots and apply resilient force to the fixing protrusions when the fixing protrusions move back and forth along the second direction in the receiving slots, the sliding block comprises a top surface and a fourth slant surface, the fourth slant surface abut the third slant surface of the locking block, the sliding block further defines a sliding slot in the top surface, each sliding slot comprises a narrow portion at the top surface of the sliding block and a wide portion below the narrow portion, a first distal end of the second connecting rod is rotatably attached to an inner surface of the second fixing groove via a spindle extending along the second direction, and a second distal end of the second connecting rod is movably received in the sliding slot via a sliding spindle extending along the second direction and movably received in the wide portion of the sliding slot.

7. The plug assembly of claim 6, wherein the transmission mechanism includes two transmission parts, each transmission part comprises a first connecting rod and a transmission pole extending along the third direction perpendicularly to the first and second direction, each transmission pole defines a cutout at a first distal end thereof, and an opening of the cutout faces the rotating spindle, a first distal end of the first connecting rod is rotatably attached to an inner surface of the first fixing groove via a spindle extending along the second direction, and a second distal end of the first connecting rod is rotatably attached to an inner surface of the cutout via a spindle extending along the second direction, second distal ends of the transmission poles opposite to the first distal ends of the transmission poles which define the cutouts pass through the second through holes and protrude out from the second through holes of the lower plate.

8. The plug assembly of claim 7, wherein the charger cover includes a bottom plate and a second side plate connected to the bottom plate, the accepting portion is connected to the second side plate, the bottom plate includes a third through hole corresponding to the first through hole and two fourth through holes corresponding to the second through holes, a hollow protruding portion extends from a bottom surface of the bottom plate, an inner surface of the protruding portion and the bottom surface of the bottom plate define an accommodating space to receive the buckling mechanism, and the third through hole communicates with the accommodating space.

9. The plug assembly of claim 8, wherein the buckling mechanism includes two pressing blocks, two seesaw assemblies located between the two pressing blocks, and a buckling block located between the two seesaw assemblies, the buckling block includes a head plate corresponding to the first through hole and a main body extends from the head plate, an area of the head plate is greater than an area of the main body adjacent to the head plate, the main body defines two first cutouts at opposite sides of a bottom surface of the main body, each pressing block defines a receiving groove at a top surface thereof and a second cutout at a bottom surface thereof, a plurality of second elastic members are fixed in the receiving grooves, second distal ends of the transmission poles protruded out of the second through hole are inserted into the receiving grooves of the pressing blocks, a weight of the buckling block is greater than a sum weight of the two pressing blocks, each seesaw assembly includes a fixing plate and a seesaw plate, center of each seesaw plate is rotatably fixed to a corresponding fixing plate, the fixing plates are attached to the bottom surface of the accommodating space, the seesaw plates are rotatably fixed to the fixing plates, first distal ends of the seesaw plates facing the buckling block are rotatably attached to the inner surfaces of the first cutouts of the buckling block, second distal end of the seesaw plates facing the pressing blocks are rotatably attached to the inner surfaces of the second cutouts of the pressing blocks.

10. The plug assembly of claim 9, wherein in use of the plug assembly, the rotating plug assembly is rotated to the protruding state, the conductive protrusions rotate to abut the bent piece of the conductive connecting blades, such that electrically connecting the plug pins and the conductive connecting blades, the rotating plug assembly also drives the transmission poles to move down along the third direction, drive the pressing blocks to move down along the third direction, drive the buckling block to move up, the head plate of the buckling block passes through the first through hole and inserts into the isosceles trapezoid groove, the rotating plug assembly drives the sliding blocks to move down, thus drive locking blocks to move closer to cover a partial portion of the first through hole, the second locking plates of the locking blocks locate below the head plate of the buckling block and lock the head plate to the locking blocks.

11. A charger assembly, comprising:

a power plug comprising a first housing defining at least two slots extending along a first direction, a rotating plug assembly, two conductive connecting blades, a transmission mechanism, and a locking mechanism comprising two locking blocks, the conductive connecting blades fixed to an inserting portion of the first housing, the rotating plug assembly comprising at least two plug pins adapted to connect with a socket of an external power source and configured to be rotatably fixed in the first housing to make the rotating plug assembly connect with the conductive connecting blades or disconnect with the conductive connecting blades, such that the rotating plug assembly changeable between a retracted state and a protruding state, the two locking blocks received in the first housing and configured to move closer or further away from each other along a second direction perpendicular to the first direction, and the transmission mechanism received in the first housing and configured to move up and down along a third direction perpendicular to the first and second directions; and a charger comprising a charger body and an accepting assembly, the accepting assembly comprising two conductive poles structured and arranged to be electrically connected to inner circuit elements of the charger body, a charger cover, and a buckling mechanism received in the charger cover, the buckling mechanism comprising a buckling block configured to move up and down along the third direction, the two conductive poles fixed to an accepting portion of the charger cover which detachably engaged with the inserting portion and allows the inserting portion to be inserted into the accepting portion to make the conductive connecting blades electrically connect with the conductive poles;

wherein in the protruding state, the rotating plug assembly connects with the conductive connecting blades such that the operation voltage of the external power source is applied to the inner circuit elements of the charger body, the rotating plug assembly drives the transmission mechanism to move down to insert into the charger cover, drives the buckling block to move up to insert into the first housing, and drives the locking blocks to move closer and lock with the buckling block; and in the retracted state, the rotating plug assembly disconnects with the conductive connecting blades, the rotating plug assembly drives the transmission mechanism to move up, drives the locking blocks to move further away from each other, such that the locking blocks release the buckling block.

12. The charger assembly of claim 11, wherein the first housing comprises a cover and a seat, the cover comprises a top plate and three sidewalls connected with three edges of the top plate, the three sidewalls connect end to end to form a first space which is exposed to the outside at a bottom side and a front side, the seat is attached to cover the exposed sides of the cover, the at least two slots comprises two slots, the top plate of the cover defines the two slots at a surface facing away from the first space, and the first housing further defines a hole extending along the second direction and communicating with the two slots.

13. The charger assembly of claim 12, wherein the rotating plug assembly comprises a rotating spindle, two controlling portions, and two plug pins, the rotating spindle is rotatably fixed in the hole of the first housing to extend along the second direction, the rotating spindle defines two first fixing grooves at opposite distal ends, each first fixing groove surrounds a circumference of the rotating spindle, the two controlling portions are sleeved on the rotating spindle, and located between the two first fixing grooves, each controlling portion comprises a first side and a second side opposite to the first side, each plug pin is connected with a first side of a corresponding controlling portion, each controlling portion defines a second fixing groove at a second side of the controlling portion, a conductive protrusion is formed on the second side of each controlling portion and electrically connected to the corresponding plug pin, the conductive protrusions rotate in unison with the rotating spindle to connect with the conductive connecting blades or disconnect with the conductive connecting blades.

14. The charger assembly of claim 13, wherein the seat comprises a lower plate and a first side plate connected to the lower plate, the inserting portion is connected to the first side plate, the inserting portion defines two inserting holes, and the inserting holes passes through both the first side plate and the inserting portion, each conductive connecting blade comprises a connecting piece, a cylinder piece, and a bent piece, the connecting piece interconnects the cylinder piece and the bent piece, the cylinder piece and the bent piece are located at a same side of the connecting piece, the cylinder pieces are received in the inserting holes of the inserting portion, and the bent pieces are configured to connect with the conductive protrusions.

15. The charger assembly of claim 14, wherein the lower plate includes a top surface and a bottom surface, the lower plate defines an isosceles trapezoid groove and a first through hole below a bottom of the isosceles trapezoid groove, a depth of the isosceles trapezoid groove is less than a thickness of the lower plate, an area of an upper surface of the isosceles trapezoid groove is greater than an area of a bottom surface of the isosceles trapezoid groove, the top surface bounds the upper surface of the isosceles trapezoid groove, and two first slant surfaces bound the waists of the isosceles trapezoid groove, two flat plates connected with the first slant surfaces bounds a partial bottom surface of the isosceles trapezoid groove, and the two flat plates defines the first through hole, each flat plate defines two receiving slots extending along the second direction, each receiving slot comprises a narrow portion at an upper surface of the flat plate, and a wide portion below the narrow portion, the lower plate further defines two second through holes and includes four slant pillars on the top surface, one of the two second through holes and two slant pillars are located at a same side of the isosceles trapezoid groove besides one of the two first slant surfaces, and the other one of the two second through holes and two slant pillars are located at an opposite side of the isosceles trapezoid groove besides the other one of the two first slant surfaces, at each side of the opposite sides of the isosceles trapezoid groove, the second through hole is located between the slant pillars, and a distance between the second through hole and the isosceles trapezoid groove is greater than a distance between the slant pillars and the isosceles trapezoid groove.

16. The charger assembly of claim 15, wherein the locking mechanism comprises two locking parts, each locking part comprises a second connecting rod, a sliding block, and the locking block, the locking block comprises a first locking plate and a second locking plate connected to the first locking plate, the first locking plate comprises a vertical surface perpendicular to the second direction, a second slant surface, and a third slant surface, the second slant surface interconnects the vertical surface and the third slant surface, the second slant surface matches with the first slant surface of the lower plate, the second locking plate is a flat plate, two fixing protrusions protrude from a bottom surface of the second locking plate, each fixing protrusion matches with the receiving slot, elastic members are fixed in the receiving slots and configured to elastically connect the fixing protrusions in the receiving slots and apply resilient force to the fixing protrusions when the fixing protrusions move back and forth along the second direction in the receiving slots, the sliding block comprises a top surface and a fourth slant surface, the fourth slant surface abut the third slant surface of the locking block, the sliding block further defines a sliding slot in the top surface, each sliding slot comprises a narrow portion at the top surface of the sliding block and a wide portion below the narrow portion, a first distal end of the second connecting rod is rotatably attached to an inner surface of the second fixing groove via a spindle extending along the second direction, and a second distal end of the second connecting rod is movably received in the sliding slot via a sliding spindle extending along the second direction and movably received in the wide portion of the sliding slot.

17. The charger assembly of claim 16, wherein the transmission mechanism includes two transmission parts, each transmission part comprises a first connecting rod and a transmission pole extending along the third direction perpendicularly to the first and second direction, each transmission pole defines a cutout at a first distal end thereof, and an opening of the cutout faces the rotating spindle, a first distal end of the first connecting rod is rotatably attached to an inner surface of the first fixing groove via a spindle extending along the second direction, and a second distal end of the first connecting rod is rotatably attached to an inner surface of the cutout via a spindle extending along the second direction, second distal ends of the transmission poles opposite to the first distal ends of the transmission poles which define the cutouts pass through the second through holes and protrude out from the second through holes of the lower plate.

18. The charger assembly of claim 17, wherein the charger cover includes a bottom plate and a second side plate connected to the bottom plate, the accepting portion is connected to the second side plate, the bottom plate includes a third through hole corresponding to the first through hole and two fourth through holes corresponding to the second through holes, a hollow protruding portion extends from a bottom surface of the bottom plate, an inner surface of the protruding portion and the bottom surface of the bottom plate define an accommodating space to receive the buckling mechanism, and the third through hole communicates with the accommodating space.

19. The charger assembly of claim 18, wherein the buckling mechanism includes two pressing blocks, two seesaw assemblies located between the two pressing blocks, and a buckling block located between the two seesaw assemblies, the buckling block includes a head plate corresponding to the first through hole and a main body extends from the head plate, an area of the head plate is greater than an area of the main body adjacent to the head plate, the main body defines two first cutouts at opposite sides of a bottom surface of the main body, each pressing block defines a receiving groove at a top surface thereof and a second cutout at a bottom surface thereof, a plurality of second elastic members are fixed in the receiving grooves, second distal ends of the transmission poles protruded out of the second through hole are inserted into the receiving grooves of the pressing blocks, a weight of the buckling block is greater than a sum weight of the two pressing blocks, each seesaw assembly includes a fixing plate and a seesaw plate, center of each seesaw plate is rotatably fixed to a corresponding fixing plate, the fixing plates are attached to the bottom surface of the accommodating space, the seesaw plates are rotatably fixed to the fixing plates, first distal ends of the seesaw plates facing the buckling block are rotatably attached to the inner surfaces of the first cutouts of the buckling block, second distal end of the seesaw plates facing the pressing blocks are rotatably attached to the inner surfaces of the second cutouts of the pressing blocks.

20. The charger assembly of claim 19, wherein in use of the plug assembly, the rotating plug assembly is rotated to the protruding state, the conductive protrusions rotate to abut the bent piece of the conductive connecting blades, such that electrically connecting the plug pins and the conductive connecting blades, the rotating plug assembly also drives the transmission poles to move down along the third direction, drive the pressing blocks to move down along the third direction, drive the buckling block to move up, the head plate of the buckling block passes through the first through hole and inserts into the isosceles trapezoid groove, the rotating plug assembly drives the sliding blocks to move down, thus drive locking blocks to move closer to cover a partial portion of the first through hole, the second locking plates of the locking blocks locate below the head plate of the buckling block and lock the head plate to the locking blocks.

* * * * *